US010101060B2

(12) United States Patent
Feng et al.

(10) Patent No.: US 10,101,060 B2
(45) Date of Patent: Oct. 16, 2018

(54) COOLING SYSTEM

(71) Applicant: Carrier Corporation, Farmington, CT (US)

(72) Inventors: Yinshan Feng, East Hartford, CT (US); Parmesh Verma, South Windsor, CT (US); Ahmad M. Mahmoud, East Hartford, CT (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 15/500,780

(22) PCT Filed: Jul. 22, 2015

(86) PCT No.: PCT/US2015/041500
§ 371 (c)(1),
(2) Date: Jan. 31, 2017

(87) PCT Pub. No.: WO2016/018692
PCT Pub. Date: Feb. 4, 2016

(65) Prior Publication Data

US 2017/0211851 A1 Jul. 27, 2017

Related U.S. Application Data

(60) Provisional application No. 62/031,617, filed on Jul. 31, 2014.

(51) Int. Cl.
*F25B 7/00* (2006.01)
*F25B 40/02* (2006.01)
(Continued)

(52) U.S. Cl.
CPC ..... *F25B 7/00* (2013.01); *F25B 6/04* (2013.01); *F25B 40/02* (2013.01); *F25B 41/043* (2013.01);
(Continued)

(58) Field of Classification Search
CPC ..... B60H 1/00585; F25B 7/00; F25B 41/043; F25B 40/02; F25B 6/04; F25B 2600/2501; F25B 2600/13; F25B 13/00; F25B 9/0088
See application file for complete search history.

(56) References Cited

U.S. PATENT DOCUMENTS 4,197,716 A 4/1980 Nussbaum
5,386,709 A 2/1995 Aaron
(Continued)

FOREIGN PATENT DOCUMENTS

CN 203615641 U 5/2014
EP 0747643 A1 12/1996
(Continued)

OTHER PUBLICATIONS

PCT International Search Report dated Oct. 7, 2015 and Written Opinion issued during the prosecution of PCT International Patent Application No. PCT/US2015/041500 (10 pages).
(Continued)

*Primary Examiner* — Emmanuel Duke
(74) *Attorney, Agent, or Firm* — Locke Lord LLP; Scott D. Wofsy

(57) ABSTRACT

A cooling system includes a main closed-loop refrigerant circuit having a compressor and a condenser. The cooling system also includes a subcooler closed-loop refrigerant circuit having a compressor and a condenser. A portion of the condenser of the subcooler circuit is in parallel with the condenser of the main circuit with respect to air flow. A single exhaust fan can be in fluid communication with both the condenser of the main circuit and the condenser of the subcooler circuit.

17 Claims, 1 Drawing Sheet

(51) Int. Cl.
*F25B 41/04* (2006.01)
*F25B 6/04* (2006.01)

(52) U.S. Cl.
CPC ... *F25B 2600/13* (2013.01); *F25B 2600/2501* (2013.01)

(56) References Cited

U.S. PATENT DOCUMENTS

| | | | | |
|---|---|---|---|---|
| 5,660,050 | A | 8/1997 | Wilson et al. | |
| 7,908,881 | B2 | 3/2011 | Kopko | |
| 8,146,373 | B2 | 4/2012 | Snow, III | |
| 8,291,723 | B1 | 10/2012 | Backman | |
| 2007/0074536 | A1* | 4/2007 | Bai | F25B 9/006 62/513 |
| 2009/0151356 | A1* | 6/2009 | Ast | F01K 23/101 60/660 |
| 2009/0266084 | A1 | 10/2009 | Radhakrishnan et al. | |
| 2010/0043475 | A1* | 2/2010 | Taras | F25B 1/10 62/331 |
| 2010/0242532 | A1 | 9/2010 | Kopko et al. | |
| 2011/0225990 | A1 | 9/2011 | Sinha | |
| 2012/0085830 | A1* | 4/2012 | Sundhar | B60H 1/00428 236/49.3 |
| 2012/0111027 | A1 | 5/2012 | Campbell et al. | |
| 2013/0047630 | A1 | 2/2013 | Lu | |
| 2013/0061615 | A1 | 3/2013 | Omer | |
| 2013/0167577 | A1 | 7/2013 | Street et al. | |
| 2013/0239603 | A1 | 9/2013 | Albertson | |
| 2014/0109605 | A1* | 4/2014 | Qu | F25B 49/02 62/118 |

FOREIGN PATENT DOCUMENTS

| | | | |
|---|---|---|---|
| WO | WO-9741398 | A1 | 11/1997 |
| WO | WO-2008/079118 | A1 | 7/2008 |
| WO | WO-2008/130412 | A1 | 10/2008 |

OTHER PUBLICATIONS

PCT International Preliminary Report on Patentability dated Jan. 31, 2017 issued during the prosecution of PCT International Patent Application No. PCT/US2015/041500 (6 pages).

Minh, N.Q., et al., "Improved Vapour Compression Refrigeration Cycles: Literature Review and Their Application to Heat Pumps", University of Ulster, United Kingdom (9 pages) (Jul. 17-20, 2006).

* cited by examiner

COOLING SYSTEM

RELATED APPLICATIONS

This application is a 371 U.S. National Phase of International PCT Patent Application No. PCT/US2016/041500, filed Jul. 22, 2015, which application claims the benefit of and priority to U.S. Provisional Patent Application No. 62/031,617 filed Jul. 31, 2014, the contents of which are incorporated herein by reference in their entirety.

BACKGROUND OF THE INVENTION

1. Field of the Invention

The present disclosure relates to refrigeration systems, and more particularly to refrigeration systems having a subcooling unit.

2. Description of Related Art

Refrigerated air conditioning systems utilize a thermal transfer cycle commonly referred to as the vapor-compression refrigeration cycle. Such systems typically include a compressor, a condenser, an expansion or throttling device and an evaporator connected in serial fluid communication with one another forming an air conditioning or refrigeration circuit. The system is charged with a condensable refrigerant (e.g., R-22 or R-410A), which circulates through each of the components in a closed loop. More particularly, the refrigerant of the system circulates through each of the components to remove heat from the evaporator and transfer heat to the condenser. The compressor compresses the refrigerant from a low-pressure superheated vapor state to a high pressure superheated vapor thereby increasing the temperature, enthalpy and pressure of the refrigerant. The refrigerant leaves the compressor and enters the condenser as a vapor at some elevated pressure where it is condensed as a result of heat transfer to cooling water and/or ambient air. The refrigerant then flows through the condenser condensing the refrigerant at a substantially constant pressure to a saturated-liquid state. The refrigerant then leaves the condenser as a high pressure liquid. The pressure of the liquid is decreased as it flows through the expansion or throttling valve causing the refrigerant to change to a mixed liquid-vapor state. The remaining liquid, now at low pressure, is vaporized in the evaporator as a result of heat transfer from the refrigerated space. This low-pressure superheated vapor refrigerant then enters the compressor to complete the cycle.

Typical refrigerated air conditioning systems are split into a "hot" side and a "cold" side. The hot side includes the condenser and the compressor with a fan near the condenser to disperse the heat generated by the system. The cold side includes the evaporator, the expansion valve and a second fan near the evaporator to route the cooled air towards the intended space.

Generally, performance of conventional systems decreases quickly with hot ambient conditions. Currently several technologies exist to improve system performance in hot ambient conditions such as subcoolers, economizers, work recovery devices and tube/suction line heat exchangers (SLHX). These typically require modification to existing systems.

Such conventional methods and systems have generally been considered satisfactory for their intended purpose. However, there is still a need in the art for improved cooling systems. The present disclosure provides a solution for this need.

SUMMARY OF THE INVENTION

A cooling system includes a main closed-loop refrigerant circuit having a compressor and a condenser. The cooling system also includes a subcooler closed-loop refrigerant circuit having a compressor and a condenser. A portion of the condenser of the subcooler circuit is in parallel with the condenser of the main circuit with respect to air flow. A single exhaust fan can be in fluid communication with both the condenser of the main circuit and the condenser of the subcooler circuit.

The refrigerant for the main circuit can be different from the refrigerant of the subcooler circuit. In certain embodiments, the refrigerant for the main circuit can be the same as the refrigerant for the subcooler circuit.

The cooling system can further include a pump and a valve in the main circuit. The pump can be configured to operate at variable speed. The valve can be controllable. The compressor of the subcooler can be battery-driven and can be configured to operate at variable speed to increase efficiency of the cooling system.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
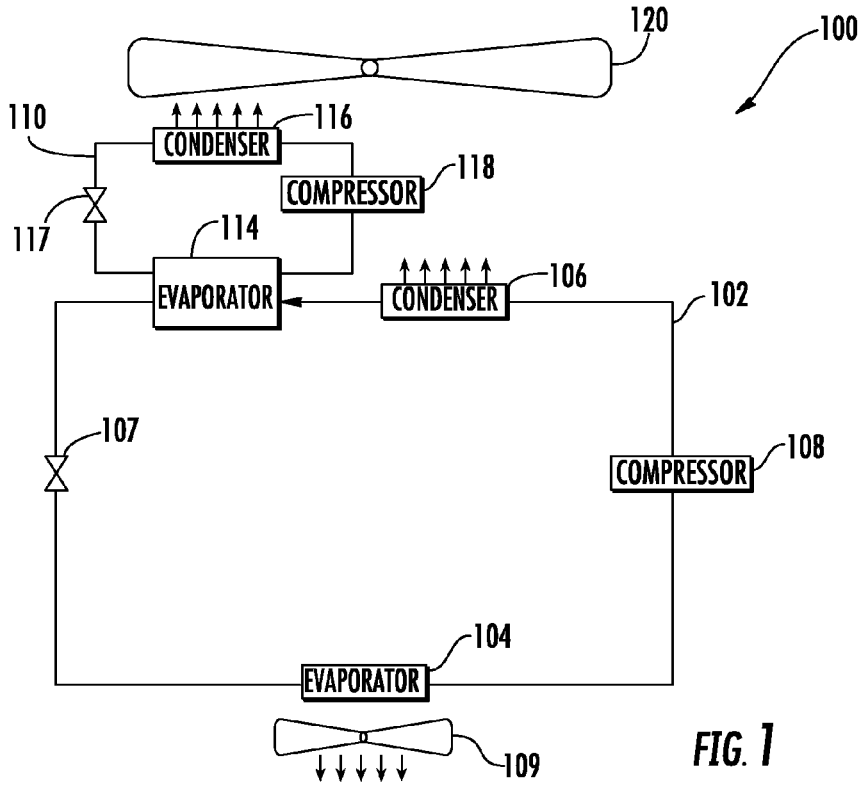
FIG. 1 is a schematic view of an exemplary embodiment of a cooling system constructed in accordance with the present disclosure, showing a main circuit and a subcooler circuit with an exhaust fan.

Reference will now be made to the drawings wherein like reference numerals identify similar structural features or aspects of the subject disclosure. For purposes of explanation and illustration, and not limitation, a partial view of an exemplary embodiment of a cooling system in accordance with the disclosure is shown in FIG. 1 and is designated generally by reference character 100. Other embodiments of the cooling system in accordance with the disclosure, or aspects thereof, are provided in FIG. 2, as will be described.

The efficient operation of refrigerated air conditioners is of continuing and ever increasing importance. There have been some efforts in the prior art to use auxiliary cooling devices such as subcoolers. However, typically this requires expensive add-ons or retrofitting of an existing refrigeration system. The present disclosure provides for a subcooler to a refrigeration system without the need to change the existing footprint of the system.

With reference to FIG. 1 an embodiment of the cooling system 100 of the present disclosure is shown. The cooling system 100 includes a main closed-loop refrigerant circuit 102. The main circuit 102 acts as a refrigeration system which circulates a refrigerant through each of the components to remove heat from an evaporator 104 and transfer heat to a condenser 106. The main circuit 102 includes a compressor 108 for compressing a refrigerant from a low-pressure superheated vapor to a high-pressure superheated vapor. The main circuit 102 also includes a condenser 106 for receiving the high-pressure superheated vapor from the compressor 108 and condensing the refrigerant to a high-pressure liquid. The main circuit 102 further includes an expansion valve 107 causing the refrigerant to change to a mixed liquid-vapor state and an evaporator to vaporize the liquid. Fan 109 positioned near the evaporator 104 directs cooled air towards a designated area.

A subcooler closed-loop refrigerant circuit 110 is positioned downstream with respect to refrigerant flow of the condenser 106 of the main circuit 102. Similar to the main circuit 102, the subcooler circuit 110 also includes a compressor 118, a condenser 116, an expansion valve 117, and an evaporator 114.

An exhaust fan 120 is positioned near the condenser 106 for the main circuit 102 and the condenser 116 for the subcooler circuit 110 for generating airflow over the condenser 106 for the main circuit 102 and the condenser 116 for the subcooler circuit 110. In this manner, the condenser 116 of the subcooler circuit 110 is in parallel with respect to air flow with the condenser 106 of the main circuit 102. With the exhaust fan 120 providing airflow to both condensers 106,116, retrofitting an existing refrigeration system is simplified compared to adding components such as exhaust fans. The parallel configuration of condensers 106 and 116 can be easily manufactured by sharing the same heat exchanger core while having separate refrigerant circuits. Also, the condenser heat exchanger core size can be kept the same to fit in an existing main circuit chassis. The compressor 118 of the subcooler circuit 110 can also be configured to operate at variable speed such that the refrigerant cooling capacity of the evaporator 114 is controllable. Furthermore, the compressor 108 in the main circuit 102 can also operate at variable speed. In order to further improve the system performance, the main circuit 102 and the subcooler circuit 110 may include the features of economizer cycle or ejector cycle. The type of the compressors 108 and 118 can include, but is not limited to, scroll, reciprocating, rotary, screw, centrifugal, and battery-driven.

Typical refrigeration systems only have a single working fluid to be passed through the components. With the cooling system 100 of the present disclosure, the refrigerant used in the main circuit 102 can be different from the refrigerant used in the subcooler circuit 110. As such, two different refrigerants may be used within cooling system. The main circuit 102 refrigerants may be selected from the group consisting of HFCs, HFOs and $CO_2$. The subcooler circuit 110 refrigerants may be any refrigerant (such as, but not limited to, HFCs, natural fluids, and et al.). Further, the subcooler can have a limited charge (e.g. <200 g) of ASHRAE Class 2L, 2 or 3 flammable refrigerants.

Figure 2:
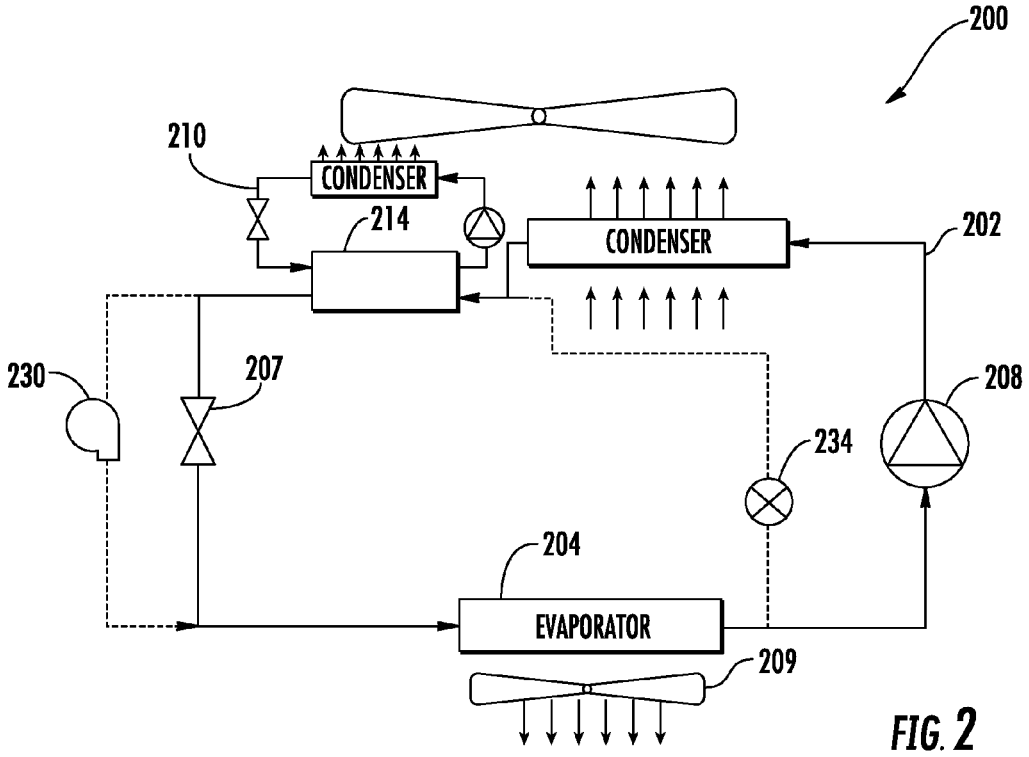
FIG. 2 is a schematic view of another exemplary embodiment of a cooling system, showing a pumping circuit in addition to a main circuit and a subcooler circuit.

With reference to FIG. 2, an additional embodiment of a cooling system 200 of the present disclosure is shown. In this embodiment, a pump 230 and a valve 234 are added to the configuration of cooling system 100 of FIG. 1. The pump 230 is positioned parallel to the expansion device 207 of the main circuit 202 with respect to refrigerant flow. The valve 234 is disposed between the evaporator 204 of the main circuit 202 and the evaporator 214 of the subcooler circuit 210. At low loads, the main circuit compressor 208 and expansion device 207 are turned off, while the subcooler circuit 210 is turned on to provide the demanded cooling. The pump 230 and valve 234 are turned on to deliver the cooling from the subcooler circuit 210 to the main circuit evaporator 204, and further cool down the air flow driven by the fan 209. The cooling system 200 will reduce the system cycling at low loads and improve the system COP by turning off the main circuit compressor 208. The pump 230 can be fixed speed or variable speed. The valve 234 can be an ON/OFF solenoid valve, a check valve, or a controllable valve.

The methods and systems of the present disclosure, as described above and shown in the drawings, provide for a cooling system with superior properties including an improved subcooler configuration. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A cooling system, comprising:

a main closed-loop refrigerant circuit having a compressor, an evaporator, an expansion device, and a condenser;

a subcooler closed-loop refrigerant circuit having a compressor, an evaporator, an expansion device, and a condenser, wherein a portion of the condenser of the subcooler circuit is in parallel with the condenser of the main circuit with respect to air flow; and a valve positioned between the evaporator of the main circuit and the evaporator of the subcooler circuit.

2. The cooling system of claim 1, further comprising a single exhaust fan in fluid communication with both the condenser of the main circuit and the condenser of the subcooler circuit.

3. The cooling system of claim 1, wherein the subcooler circuit refrigerant is the same as the main circuit refrigerant.

4. The cooling system of claim 1, wherein the subcooler circuit refrigerant is different from the main circuit refrigerant.

5. The cooling system of claim 1, wherein the compressor of the subcooler is battery-driven.

6. The cooling system of claim 1, wherein the compressor of the main circuit is configured to operate at variable speed.

7. The cooling system of claim 1, further comprising a pump in the main circuit.

8. The cooling system of claim 7, wherein the pump is configured to operate at variable speed.

9. The cooling system of claim 1, wherein the valve is controllable.

10. A cooling system, comprising:

a main closed-loop refrigerant circuit having a compressor for compressing a refrigerant receiving the high-pressure superheated vapor from the compressor and condensing the refrigerant to a high-pressure liquid, and an expansion device to throttle the high-pressure liquid;

a subcooler closed-loop refrigerant circuit having a compressor for compressing a refrigerant from a low-pressure superheated vapor to a high-pressure superheated vapor and a condenser for receiving the high-pressure superheated vapor from the compressor and condensing the refrigerant to a high-pressure liquid; and an exhaust fan for generating an airflow over the condenser of the main circuit and the condenser of the subcooler circuit, wherein the condenser of the subcooler circuit is in parallel with the condenser of the main circuit with respect to air flow; and a valve positioned between the evaporator of the main circuit and the evaporator of the subcooler circuit.

11. The cooling system of claim 10, wherein the subcooler circuit refrigerant is the same as the main circuit refrigerant.

12. The cooling system of claim 10, wherein the subcooler circuit refrigerant is different from the main circuit refrigerant.

13. The cooling system of claim 10, wherein the compressor of the subcooler is battery-driven.

14. The cooling system of claim 10, wherein the compressor of the main circuit is configured to operate at variable speed.

15. The cooling system of claim 10, wherein the main circuit further includes a pump.

16. The cooling system of claim 15, wherein the pump is configured to operate at variable speed.

17. The cooling system of claim 10, wherein the valve is controllable.

* * * * *